US005275293A

United States Patent [19]

Crider

[11] Patent Number: 5,275,293

[45] Date of Patent: Jan. 4, 1994

[54] ROCK CRUSHER AGGREGATE SCREEN REPAIR ACCESSORY APPARATUS AND METHOD OF COMPLYING TO GRADATION SPECIFICATIONS

[76] Inventor: Ronald L. Crider, 9416 E. Wasatch Pl., Tucson, Ariz. 85749

[21] Appl. No.: 989,775

[22] Filed: Dec. 14, 1992

[51] Int. Cl.[5] ..... B07B 1/28

[52] U.S. Cl. ..... 209/319; 209/403; 245/2

[58] Field of Search ..... 209/233, 319, 363, 402, 209/403; 245/2

[56] References Cited

U.S. PATENT DOCUMENTS

| | | | |
|---|---|---|---|
| 1,324,845 | 12/1919 | Osgood | 245/2 |
| 1,749,755 | 3/1930 | Downer | 245/2 |
| 1,792,594 | 2/1931 | Litwin | 245/2 |
| 1,927,826 | 9/1933 | Friday | 245/2 |
| 1,998,033 | 4/1935 | Tucker | 245/2 |
| 2,190,993 | 2/1940 | Muir | 209/319 |
| 2,241,257 | 5/1941 | Gronberg | 140/3 R |
| 2,272,196 | 2/1942 | Gittens | 245/2 |
| 2,283,803 | 5/1942 | Gittens | 245/2 |
| 2,397,646 | 4/1946 | Brown et al. | 245/2 |
| 2,487,830 | 11/1949 | Robbins, II | 428/229 |
| 3,016,203 | 1/1962 | Sears et al. | 241/24 |
| 4,760,980 | 8/1988 | Sharpe | 245/2 |

*Primary Examiner*—D. Glenn Dayoan

*Attorney, Agent, or Firm*—Victor Flores

[57] ABSTRACT

An aggregate screen repair/screen modification kit including at least one screen patch member. The screen patch member is formed from a rigid mesh material that requires a hand tool to effect a repair, or modification task, and that also conforms to specified mesh material strength requirements of a damaged aggregate screen, or of a functional screen section that needs to be modified. The shape of the screen is the same as the damaged screen area, or the modification area on the screen section to be modified. The screen patch member is provided with a plurality of first engagement members and a plurality of oppositely disposed second engagement members. To obtain a reliable screen patch, the first and second plurality of engagement members are provided with complementary and co-acting engagement structure for co-acting with each other for effecting a continuous, firm, stable, and fixed engagement with the mesh elements associated with the damaged screen area, or with the mesh elements associated with the modification area. The engagement may be by hooking/clamping or by merely clamping, depending upon the screen structure selected. To assure an even distribution of an aggregate material being processed through the mesh, the screen patch is formed having an impact mesh surface made up of a plurality of criss-cross points that define a rigid plane having the same rigidity as the primary screen.

7 Claims, 3 Drawing Sheets

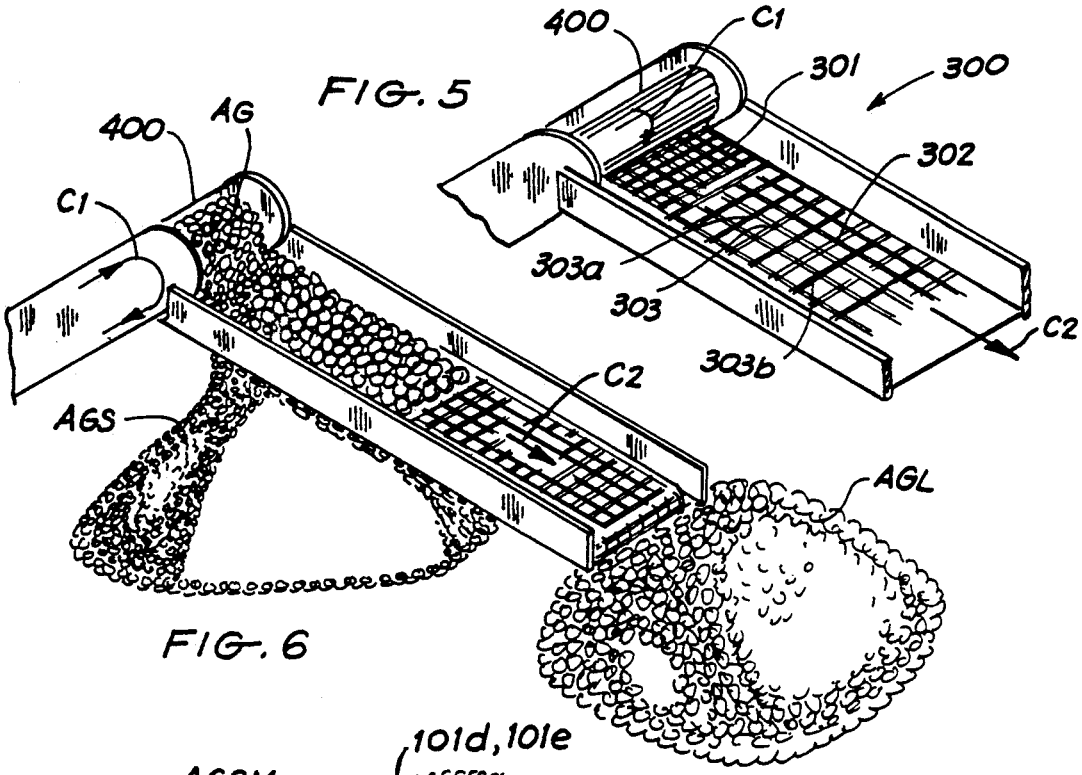
FIG. 5
FIG. 6
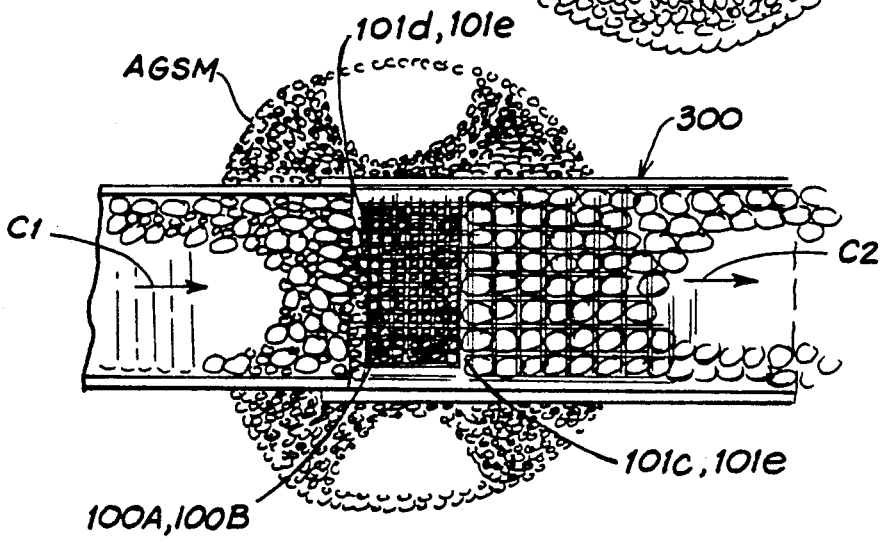
FIG. 7

ROCK CRUSHER AGGREGATE SCREEN REPAIR ACCESSORY APPARATUS AND METHOD OF COMPLYING TO GRADATION SPECIFICATIONS

FIELD OF THE INVENTION

The present invention relates to aggregate screens. More particularly, the present invention relates to aggregate screen accessory apparatus used to selectively modify the screen mesh size to meet aggregate gradation specifications, or to repair a plurality of damaged screen mesh area(s).

BACKGROUND OF THE INVENTION

The prior art teaches that metallic screen structures (also termed cloths) are used in the rock aggregate business to size aggregate according to end use applications i.e. ¼ inch, ¾ inch, 1 inch, and smaller sizes. The screen structures are generally positioned in an incline below a conveyer belt crusher and must be formed from a hardened steel to sustain the pounding of the crushed material. However, since nothing lasts forever, certain areas of the screen develop breaks such that larger than desired aggregate fall through to contaminate the screened pile of material below the screen. Present practice is to use V-belt strips interwoven to block the broken grid to prevent contamination of the material below. This method is very time consuming.

The following is a list of the U.S. Pat. Nos. relating to this invention.

| U.S. Pat. No. | Inventor | Date of Issue |
|---|---|---|
| 1,749,755 | D. Downer | March 11, 1930 |
| 1,998,033 | F.E. Tucker | April 16, 1935 |
| 1,927,826 | R.W. Friday | September 26, 1933 |
| 1,324,845 | D. Osgood | December 16, 1919 |
| 2,241,257 | C. Gronberg | May 6, 1941 |
| 2,272,196 | S.R. Gittens | February 10, 1942 |
| 2,283,803 | S.R. Gittens | May 19, 1942 |
| 2,487,830 | C. Robbins, II | November 15, 1949 |
| 2,190,993 | H.H. Muir | February 20, 1940 |
| 3,016,203 | C.G. Sears, et al. | January 9, 1962 |

The above listed patents can be categorized into three groups, Group I including U.S. Pat. Nos. 2,190,993 and 3,016,203, pertaining to replaceable crusher screens and crusher systems. Group II includes U.S. Pat. Nos. 1,324,845, 2,272,196, 2,283,803, and 2,487,830, pertaining to screen repair devices where the ends of the repair screens are formed to effect a grip on the damaged screen. Group III includes U.S. Pat. Nos. 1,749,755, 1,998,033, 1,927,826, and 2,241,257 pertaining to screen repair devices where a clamping element has been added near the periphery of the patch to effect the interconnection to the damaged screen. Although the prior art teaches repair of screens in the window/door industry, see generally U.S. Pat. Nos. 2,272,196 and 2,283,803 to Gittens, pertaining to screen patches with hook formed ends, and although the prior art also teaches replacing a complete screen in a crusher system, see U.S. Pat. No. 2,190,993, none of the above listed prior art patents teach screen apparatus for repairing or modifying the extremely rigid type of screens used in rock crusher systems. In particular, the prior art does not teach a screen repair kit that includes a patch member having engagement structure adapted to endure rugged pounding action seen in a rock crusher environment. The Gittens patents, while teaching a hook engagement structure(s) for repairing screens, the hook engagement structure(s) taught does not adequately maintain the patch member in rigid locking engagement manner to keep the patch fixedly in-place over the ruptured portion of the primary screen. The patch member for aggregate screens should not be allowed to move and create a counter-productive situation in the main objective of producing a particular aggregate yield rate. It is believed that if the patch is allowed to move while in place over the screen rupture, the movement may not be in unison with the shaker movement of the primary screen, hence a non-uniform rate of aggregate screening may result. Further, while U.S. Pat. No. 2,190,993 teaches a gradation system with a plurality of gradation screens, the only structure contemplated for modifying the screen deck, for aggregate specification control or for damaged screens, is by replacing the entire screen, i.e. a costly inventory situation is created.

Thus, a need is seen to exist for an aggregate screen repair/modification kit that contains overlay portions of the same or smaller screen mesh structure having terminating ends formed for engaging to the main screen grid at the damaged screen area, or to the screen section to be modified.

A need is also seen to exist for an aggregate screen repair/modification kit that contains overlay portions of the same or smaller screen mesh structure having terminating ends formed for hooking to the primary screen at one end of the damaged mesh section, or screen section to be modified, and terminating ends at the other end formed to snap-fit (compression fit), or clamp to the damaged mesh section's other end.

A need is also seen to exist for an aggregate screen repair/modification kit that contains overlay portions of the same or smaller screen mesh structure having terminating ends formed having an impact point for effecting outward clamping securement to mesh elements associated with a damaged screen area, or a screen section to be modified.

SUMMARY OF THE INVENTION

Accordingly, the primary object of the present invention is to provide an aggregate screen repair/modification kit that contains overlay portions of the same or smaller screen mesh structure having terminating ends formed for engaging to the main screen grid at the damaged screen area, or to the screen section to be modified in accordance with all of the foregoing needs.

The foregoing objects are accomplished by providing an aggregate screen repair/screen modification kit apparatus, said apparatus comprising: at least one screen patch member, said at least one screen patch member being formed from a substantially rigid mesh material that requires at least one hand tool to effect a repair, or modification task and that also conforms to specified mesh material strength requirements of a damaged aggregate screen, or a screen section to be modified, said at least one screen patch member comprising a shape that is larger than a damaged screen area on said damaged aggregate screen, or a modification area on said screen section to be modified, said at least one screen patch member having a plurality of first engagement members and a plurality of oppositely disposed second engagement members, said first and second plurality of engagement members each having respective, complementary and co-acting engagement structure for co-acting with each other for effecting a continuous, firm, stable, and fixed engagement with corresponding mesh elements associated with said damaged screen area, or with corresponding mesh elements associated with said modification area, said at least one screen patch member being formed having an impact mesh surface and a non-impact mesh under-surface, said impact mesh surface comprising a plurality of criss-cross points that define a rigid plane having the same rigidity as said substantially rigid mesh material and which provides a uniform mesh surface for even distribution of an aggregate material being processed therethrough.

Therefore, to the accomplishments of the foregoing objects, the invention consists of the foregoing features hereinafter fully described and particularly pointed out in the claims, the accompanying drawings and the following disclosure describing in detail the invention, such drawings and disclosure illustrating but one of the various ways in which the invention may be practiced.

BRIEF DESCRIPTION OF THE DRAWINGS

FIG. 5 is an aggregate screen structure in close proximity to a conveyer mechanism for receiving aggregate material, illustrating a screen modification area within one of the screen sections of the aggregate screen sections selected to be modified.

FIG. 6 is an unmodified aggregate screen structure in close proximity to a conveyer mechanism receiving aggregate material, illustrating smaller aggregate material being processed through the screen section and larger material being screened through.

FIG. 7 is an aggregate screen structure modified in accordance with the present invention whereby a screen patch member has been engaged about a modification area, such as the modification section shown in FIG. 5, for producing aggregate material that meets a predetermined aggregate gradation specification.

DESCRIPTION OF THE PREFERRED EMBODIMENT

Figure 1:
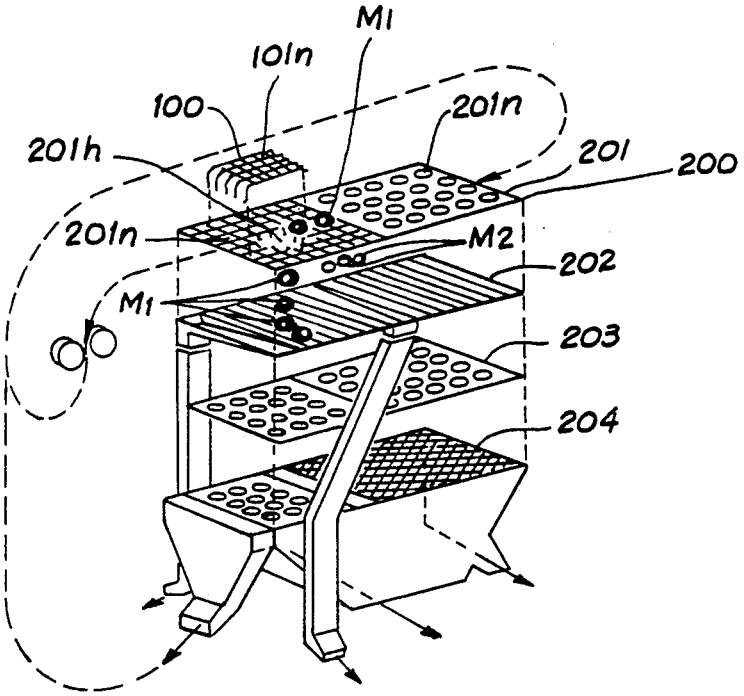
FIG. 1 is a perspective view of an aggregate crusher system illustrating a screen deck structure and a screen patch member in accordance with the present invention above a damaged screen area.

Referring now to FIG. 1, showing an aggregate crusher system 200 including a plurality of screening decks 201, 202, 203 and 204. Screen system 200 and the suitably arranged screen decks are designed to process aggregate material M2 to a lower screen deck via normal mesh opening 201*n* and to screen out larger aggregate material M1. As noted earlier, nothing lasts forever, and certain areas of the screen system, typically the upper deck, such as screen deck 201 develop breaks 201*h* such that larger than desired aggregate material M1 falls through to contaminate the screened pile of material M2 below screen 201. Present practice is to use V-belt strips interwoven to block the broken grid to prevent contamination of the material below. This method is deemed very time consuming. The present invention is illustrated in FIG. 1 above screen deck 201 in the form of a screen patch 100 having screen mesh openings 100*n* sized the same as mesh openings 201*n*.

Figure 2:
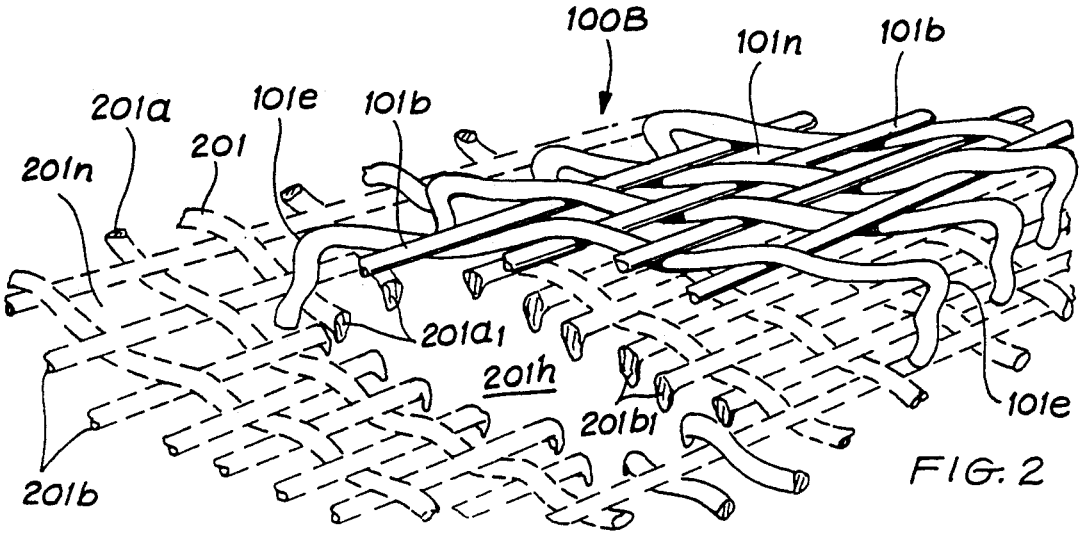
FIG. 2 is an enlarged view of a damaged aggregate screen area prepared for the engagement of a screen patch member having outer clamping type of engagement ends.
Figure 3:
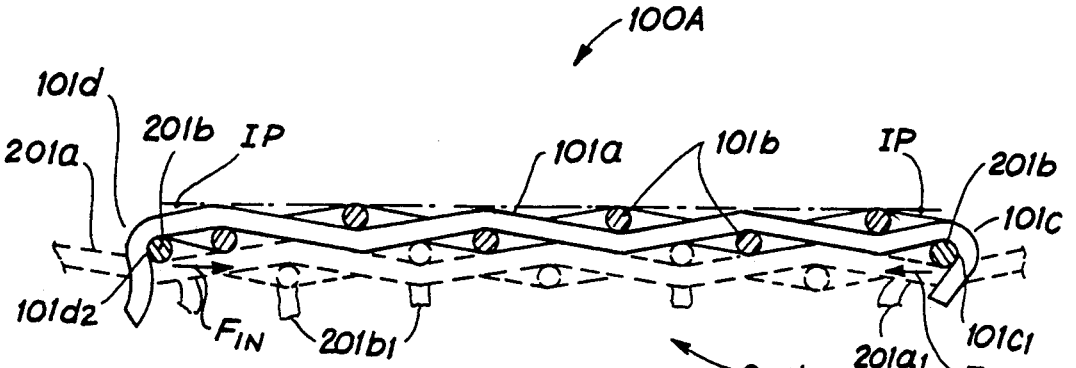
FIG. 3 is a typical section view of an installed screen patch having hooking end portions at one end and inward clamping end portions at an other end, both end co-acting toward each other to provide a stable securement to the damaged screen area or a screen area being modified.
Figure 4:
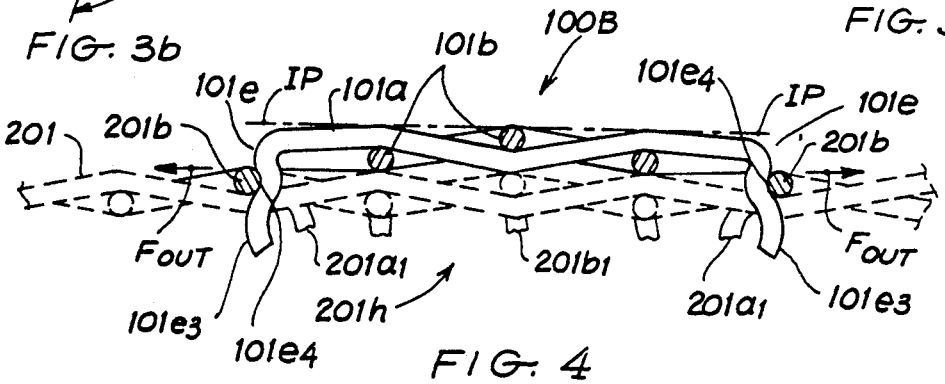
FIG. 4 is a typical section view of an installed screen patch having outward clamping end portions at opposing ends, both ends co-acting outwardly at respective outer cradle portions to provide a stable securement to the damaged screen area.

By example, FIGS. 3 and 4 illustrate two embodiments 100A and 100B of the screen patch members of the present invention. Before further describing embodiments 100A and 100B further, it should be understood that a screen repair or screen modification task may require at least one screen patch member, or several if multiple breaks in the screen have occurred, or a gradation specification requires screening out more than one aggregate size. Also, because of the rugged application environment, each screen patch member is preferably formed from a substantially rigid mesh material that requires at least one hand tool to effect a repair or modification task. Further, the screen patch member is preferably formed to conforms to specific mesh material strength requirements which are the same as the damaged aggregate screen, or of an aggregate screen to be modified to meet a predetermined aggregate gradation specification. Further, to assure that the screen patch member provides a uniform mesh surface for even distribution of an aggregate material being processed therethrough, the screen patch member is preferably formed having an impact mesh surface comprising a plurality of criss-cross points that define a rigid plane, such as planes depicted by line IP—IP in FIGS. 3 and 4 and having the same rigidity as the screen mesh material that is being repaired or modified. The shape of the screen patch member depends upon whether the task at hand is to repair a screen deck, such as screen deck 201, that has been damaged to the point that contamination is causing out-of-specification conditions, or whether the task requires meeting an aggregate gradation specification. In meeting an aggregate gradation specification, the task may require a lesser amount of a large aggregate that is normally being processed. To accomplish this objective, a portion of a functional aggregate screen structure, such as modification area 303 of structure 300 shown in FIG. 5, is designated as a modification area. The modification area determines the size of the screen patch to be engaged thereto. The screen patch shape is at least as large as the damaged screen area or the modification area, but typically the shape is larger. FIG. 2 shows an enlarged view of a damaged aggregate screen area 201*h* prepared for the engagement of a screen patch member 100B having outer clamping end portions 101*e*, discussed in more detail below.

Figure 3B:
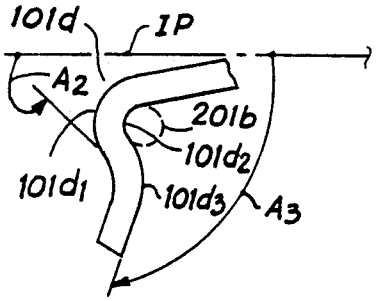
FIG. 3*b* is an enlarged view of an inward clamping end portion of a screen patch member, illustrating primarily the cradle portion formed in the same shape as a mesh section of a primary screen being repaired or modified, and an impact/lock point in the form of a bend member.
Figure 3A:
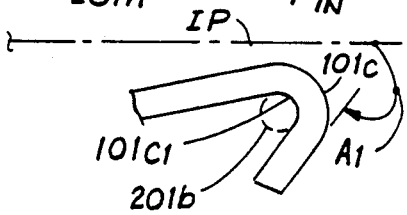
FIG. 3*a* is an enlarged view of a hooking end portion of a screen patch member, illustrating primarily the cradle portion formed in the same shape as a mesh section of a primary screen being repaired or modified.

Referring back to FIG. 3, screen patch 100A is shown installed to damaged section 201*h*. Here screen patch 100A is formed having a firs engagement member in the form of hooking end portions 101*c* at one end, hooked to mesh element member 201*b*, and a second engagement member in the form of an inward clamping end portions 101*d* at an other end clamping mesh element 201*b*, both ends 101*c* and 101*d* co-acting toward each other as indicated by arrows Fin to provide a stable securement to the damaged screen area. FIG. 3*a* shows an enlarged view of a hooking end portion 101*c*, illustrating primarily the cradle portion 101*c*1 formed in the same shape as a mating mesh section of a primary screen being repaired or modified, by example, a semi-circular shape to conform to a semi-circular part of a primary screen mesh formed from a circular steel rod material. Hooking end portion 101*c* is seen to form an obtuse angle A1, measured with respect to the material impact mesh surface, see plane IP—IP in FIG. 3, to effect an inward hooking action. FIG. 3*b* shows an enlarged view of the opposing inward clamping end portion 101*d*, illustrating primarily the cradle portion 101*d*2 formed in the same shape as a mating mesh section of a primary screen being repaired or modified, similar to cradle portion 101*c*1, and provided with an impact/lock point 101*d*3 in the form of a bend member. Inward clamping portion 101*d* is seen to be formed having a first bend member 101*d*1, said first bend member 101*d*1 extending away from the impact mesh surface IP—IP forming an obtuse angle A2, measured with respect to the impact mesh surface. First bend member 101*d*1 extending towards second bend member 101*d*3. Second bend member 101*d*3 further extending in a counter direction and forming a obtuse angle A3. As noted above, second bend member 101*d*3 defines a knuckle-like, lock-point, having the same numeral 101*d*3. Lock-point 101*d*3 being an outwardly urging impact point for effecting an inward clamping securement, depicted by arrow Fin in FIG. 3, acting at cradle portion 101*d*2.

Figure 4A:
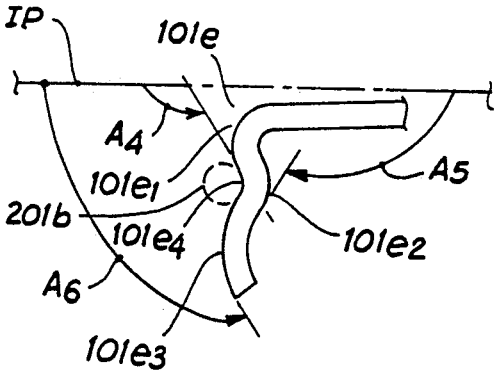
FIG. 4*a* is an enlarged view of an outward clamping end portion of a screen patch member, illustrating primarily the outer cradle portion formed in the same shape as a mesh section of a primary screen being repaired or modified, and an impact/lock point in the form of a bend member.

FIG. 4 shows screen patch embodiment 100B installed to damaged screen section 201*h*. Screen patch 100B is shown having the same type of engagement members, in the form of an outward clamping end portions 101*e*, located at opposing ends of warped mesh element 101*a*. End portions 101*e* are designed for co-acting outwardly, as depicted by outward force arrow Fout, at respective outer cradle portions 101*e*4, acting outwardly on mesh elements 201*b* to provide a stable securement to the damaged screen area. Each outward clamping bent portion 101*e* on one side being a mirror image of an opposed outward clamping bent portion 101*e* on the other side. FIG. 4*a* shows an enlarged view of outward clamping end portion 101*e* of screen patch member 100B, and further illustrating outer cradle portion 101*e*4 formed in the same shape as a mesh section of a primary screen being repaired or modified, by example, a semi-circular shape to conform to a semi-circular part of a primary screen mesh formed from a circular steel rod material, and also further illustrating an impact/lock point 101*e*3 in the form of a bend member, also designated 101*e*3. Outward clamping portion 101*e* is seen to be formed having a first bend member 101*e*1 and extending away from impact mesh surface, see plane IP—IP in FIG. 4, forming a first obtuse angle A4, measured with respect to the impact mesh surface. First bend member 101*e*1 extends towards a second bend member 101*e*2. Second bend member 101*e*2 further extends in a counter direction and forms a second obtuse angle A5. Second bend member 101*e*2 extends towards a third bend member 101*e*3. Third bend member 101*e*3 further extends in a counter direction from second bend member 101*e*2 and forms a third obtuse angle A6. First and third bend members 101*e*1 and 101*e*3 defining therebetween outer cradle portion 101*e*4. Third bend member 101*e*3 defining a knuckle-like, lock-point 1-1*e*3. Lock-point 101*e*3 being an urging/impact point for effecting an outward clamping securement as indicated by arrows Fout in FIG. 4 by acting at outer cradle portion 101*e*4 on a cradled mesh element, such as element 210*b* associated with damaged screen 201.

As shown in FIG. 2, damaged screen area 201*h* is formed of a plurality of criss-cross members 201*a* and 201*b*, each having a respective broken end 201*a*1 and 201*b*1. By example, criss-cross member 201*a* is shown as a warped member, while criss-cross member 201*b* is shown as a substantially straight member. As shown in FIGS. 3 and 4, screen patch members 100A and 100B comprise criss-cross members 101*a* and 101*b*. By example, criss-cross members 101*a* are depicted as warped, while criss-cross members 101*b* are shaped substantially straight. In patching screen 201, patch member 100B is preferably installed such that the plurality of criss-cross members 101*b* are oriented parallel with criss-cross members 201*b*. In general, the damaged screen area is prepared for engaging screen patch member 100A, 100B, such as by cutting/dressing broken ends 201*a*1, 201*b*1. Since the material is substantially rigid, the task of installing the screen patch requires providing an impact hand tool for impacting the screen patch to urge impact points 101*d*3 on screen patch member 100A, or impact points 101*e*3 on screen patch 100B. Screen 100A requires an initial step of hooking the hooking portions 101*c* to appropriate mesh element on the damaged screen prior to impacting the clamp 101*d* into a locked position. Screen 100B requires being positioned over the damaged screen area and then impacting clamps 101*e* into locked positions.

The present invention has application in an industrial environment such as depicted in FIGS. 5 and 6. FIGS. 5 and 6, by example, show an aggregate screen structure 300 in close proximity to a conveyor mechanism 400 for receiving, in direction C1, aggregate material AG and processing smaller aggregate material AGS through the screen mesh and screening out larger material AGL by shaking action depositing material in the direction C2. As noted previously, meeting an aggregate gradation specification may require a lesser amount of a large aggregate that is normally being processed, i.e. a lesser amount of the larger material in material AGS. To accomplish this objective, a functional aggregate screen structure 300 comprising, by example, screen sections 301 and 302, may be modified to screen out the desired amount of the large aggregate. By example, a portion 303 of section 302 may be designated as a modification area. Portion 303 is prepared by cutting the screen along boundaries 303*a* and 303*b*. The prepared modification area 303 is analogous to a damaged screen, such as screen area 201*h*. The screen patch apparatus of the present invention may be utilized. The screen modification may utilize either screen patch 100A or 100B and be installed in a similar manner as described above for the damaged screen. FIG. 7 shows aggregate screen structure 300 modified in accordance with the present invention whereby either of screen patch members 100A, or 100B has been engaged about modification area 303 for producing aggregate material AGSM that meets a predetermined aggregate gradation specification.

Therefore, while the present invention has been shown and described herein in what is believed to be the most practical and preferred embodiment, it is recognized that departures can be made therefrom within the scope of the invention, which scope is therefore not to be limited to the details disclosed herein but is to be accorded the full scope of the claims so as to embrace any and all equivalent apparatus.

I claim:

1. An aggregate screen repair kit apparatus, said apparatus comprising:

at least one screen patch member, said at least one screen patch member being formed from a substantially rigid mesh material that requires at least one hand tool to effect a repair task and that also conforms to specified mesh material strength requirements of a damaged aggregate screen, said at least one screen patch member comprising a shape that is larger than a damaged screen area on said damaged aggregate screen, said at least one screen patch member having a plurality of first engagement members and a plurality of oppositely disposed second engagement members, said first and second plurality of engagement members each having respective, complementary and co-acting engagement structure for co-acting with each other for effecting a continuous, firm, stable, and fixed engagement with corresponding mesh elements associated with said damaged screen area, said at least one screen patch member being formed having an impact mesh surface and a non-impact mesh under-surface, said impact mesh surface comprising a plurality of criss-cross points that define a rigid plane having the same rigidity as said substantially rigid mesh material and which provides a uniform mesh surface for even distribution of an aggregate material being processed therethrough, each one of said plurality of first engagement members comprise a hooking bent portion extending towards said non-impact mesh under-surface and forming an obtuse angle, said obtuse angle being measured with respect to said impact mesh surface, said hooking bent portion defining a cradle portion shaped the same as a respective one of said corresponding mesh elements associated with said damaged screen area.

2. An aggregate screen repair kit apparatus as describe in claim 1, wherein:

each one of said plurality of second engagement members comprise an inwardly clamping bent portion defined by integrally formed, first and second bend members, said first bend member extending away from said impact mesh surface forming a first obtuse angle, measured with respect to said impact mesh surface, said first bend member defining a cradle portion shaped the same as a respective one of said corresponding mesh elements associated with said damaged screen area, said first bend member extending towards said second bend member, said second bend member further extending in a counter direction and forming a second obtuse angle, said second bend member defining a knuckle-like, lock-point, said lock-point being an outwardly urging impact point for effecting an inward clamping securement in said cradle portion of said corresponding mesh elements associated with said damaged screen area.

3. An aggregate screen repair kit apparatus, said apparatus comprising:

at least one screen patch member, said at least one screen patch member being formed from a substantially rigid mesh material that requires at least one hand tool to effect a repair task and that also conforms to specified mesh material strength requirements of a damaged aggregate screen, said at least one screen patch member comprising a shape that is larger than a damaged screen area on said damaged aggregate screen, said at least one screen patch member having a plurality of first engagement members and a plurality of oppositely disposed second engagement members, each one of said plurality of first and second engagement members comprise an outward clamping bent structure defined by integrally formed first, second and third bend members, each outward clamping bent structure associated with a first engagement member being a mirror image of an opposed outward clamping bent structure associated with a second engagement member, said first and third bend members defining therebetween an outer cradle portion, said third bend member defining a knuckle-like, lock-point, said lock-point being an urging impact point for effecting outward clamping securement in said outer cradle portion of corresponding mesh elements associated with a damaged screen area, said first and second plurality of engagement members for co-acting with each other for effecting a continuous, firm, stable, and fixed engagement with corresponding mesh elements associated with said damaged screen area.

4. An aggregate screen repair kit apparatus as describe in claim 3, wherein:

said at least one screen patch member being formed having an impact mesh surface and a non-impact mesh under-surface, said impact mesh surface comprising a plurality of criss-cross points that define a rigid plane having the same rigidity as said substantially rigid mesh material and which provides a uniform mesh surface for even distribution of an aggregate material being processed therethrough.

5. An aggregate screen repair kit apparatus as describe in claim 4, wherein:

said first bend member extends away from said impact mesh surface forming a first obtuse angle, measured with respect to said impact mesh surface, said first bend member extending towards said second bend member, said second bend member further extending in a counter direction from said first bend member and forming a second obtuse angle, said second bend member extending towards said third bend member, said third bend member further extending in a counter direction from said second bend member and forming a third obtuse angle.

6. A method of meeting aggregate gradation specifications, said method comprising the steps of:

(a) providing an aggregate gradation specification;

(b) providing at least one screen modification member, said at least one screen modification member being formed from a substantially rigid mesh material that conforms to mesh material strength requirements of a functional aggregate screen structure to be modified, said at least one screen modification member having a shape sized to fit a predetermined modification area of said functional aggregate screen structure, and also having a screen mesh size smaller than said functional aggregate screen structure in accordance with said provided specification, said at least one screen modification member having a plurality of first engagement members and a plurality of oppositely disposed second engagement members, said first and second plurality of engagement members each having respective, complementary and co-acting engagement structure for co-acting with each other for effecting a continuous, firm, stable, and fixed engagement with corresponding mesh elements associated with said functional aggregate screen structure, each one of said plurality of first engagement members having an inwardly hooking bent portion, said hooking bent portion defining a first cradle portion shaped the same as a respective one of said corresponding mesh elements associated with said functional aggregate screen structure, each one of said plurality of second engagement members having an inwardly clamping bent portion defined by integrally formed, first and second bend members, said first bend member defining a second cradle portion shaped the same as a respective one of said corresponding mesh elements associated with said functional aggregate screen structure, said second bend member defining a knuckle-like, lock-point, said lock-point being an urging impact point for effecting inward clamping securement in said first and second cradle portions of said corresponding mesh elements associated with said functional aggregate screen structure;

(c) preparing said modification area for engaging said at least one screen modification member by cutting said functional aggregate screen structure along boundaries defining said modification area;

(d) providing an impact tool;

(e) engaging said at least one screen modification member to said functional aggregate screen structure about said modification area utilizing said first and second plurality of engagement members to effect modifying said functional aggregate screen structure by hooking respective ones of said corresponding mesh elements within said first cradle portion and urging said impact points over other respective ones of said corresponding mesh elements using said provided impact tool for securement in said second cradle portion to effect said inward clamping securement of said at least one screen modification member to said modification area; and (f) screening out a desired amount of aggregate material to meet said provided aggregate gradation specification.

7. A method of repairing a damaged aggregate screen, said method comprising the steps of:

(a) providing at least one screen patch member, said at least one screen patch member being formed from a substantially rigid mesh material that conforms to mesh material strength requirements of an aggregate screen having a damaged screen area, and that requires at least one hand tool to effect a repair task and, said at least one screen patch member comprising a shape that is larger than said damaged screen area on said damaged aggregate screen, said at least one screen patch member having a plurality of first engagement members and a plurality of oppositely disposed second engagement members, each one of said plurality of first engagement members having an inwardly hooking bent portion, said hooking bent portion defining a first cradle portion shaped the same as a mesh element associated with said damaged screen area, each one of said plurality of second engagement members having an inwardly clamping bent portion defined by integrally formed, first and second bend members, said first bend member defining a second cradle portion shaped the same as a said mesh element associated with said damaged screen area, said second bend member defining a knuckle-like, lock-point, said lock-point being an urging impact point for effecting inward clamping securement of said mesh elements associated with said damaged screen area; and (b) preparing said damaged screen area for engaging said at least one screen patch member by dressing broken ends of said damaged screen area;

(c) providing an impact hand tool; and (d) engaging said at least one screen patch member by hooking said mesh elements within said first cradle portion and urging said impact points over other mesh elements using said provided impact tool for securement in said second cradle portion to effect repairing said damaged aggregate screen.

* * * * *